US008474972B2

(12) United States Patent
Sutton et al.

(10) Patent No.: US 8,474,972 B2
(45) Date of Patent: Jul. 2, 2013

(54) RIB PROFILE FOR REDUCED CONTACT PRESSURE IN A PRINTING DEVICE

(75) Inventors: Donald Christopher Sutton, Camas, WA (US); Alvin Marion Post, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 80 days.

(21) Appl. No.: 13/178,222

(22) Filed: Jul. 7, 2011

(65) Prior Publication Data

US 2013/0010042 A1 Jan. 10, 2013

(51) Int. Cl.
*B41J 2/01* (2006.01)

(52) U.S. Cl.
USPC ..... 347/104; 347/101

(58) Field of Classification Search
USPC ..... 347/104, 31
See application file for complete search history.

(56) References Cited

U.S. PATENT DOCUMENTS

| | | | | |
|---|---|---|---|---|
| 5,927,704 | A | 7/1999 | Quackenbush et al. | |
| 6,763,217 | B2 | 7/2004 | Bloemen et al. | |
| 7,470,018 | B2 | 12/2008 | Miyazaki et al. | |
| 7,673,985 | B2 | 3/2010 | Sasa | |
| 2005/0062794 | A1 * | 3/2005 | Kanamitsu et al. | 347/31 |
| 2007/0109384 | A1 * | 5/2007 | Takeda et al. | 347/104 |
| 2008/0180507 | A1 | 7/2008 | Furukawa | |
| 2008/0186374 | A1 * | 8/2008 | Ito et al. | 347/104 |

* cited by examiner

*Primary Examiner* — Manish S Shah
*Assistant Examiner* — Yaovi Ameh

(57) ABSTRACT

A printing device component may include a base surface and a plurality of ribs extending away from the base surface. Each rib may include a nominal guiding surface, one or more primary transition surfaces, one or more secondary transition surfaces, and one or more angled surfaces. Each primary transition surface may begin at a top surface and end at a secondary transition surface. Each secondary transition surface may begin at a primary transition surface and end at an angled surface. Each angled surface may begin at a secondary transition surface and end at the base surface.

13 Claims, 4 Drawing Sheets

FIG. 4

RIB PROFILE FOR REDUCED CONTACT PRESSURE IN A PRINTING DEVICE

BACKGROUND

Printing device components (e.g., platens or other components) may include ribs, rib structures, and/or similar features, upon which an image medium may be supported. A rib or series of ribs may, for example, support an image medium while ink nozzles, ink orifices, and/or other devices apply ink or other substances to the image medium to create an image on the image medium. An image medium may be supported by ribs rather than by a flat plate so that excess ink that is applied beyond the borders of image medium may be collected. Printing device components may also include ribs for convenience of design or for other reasons.

Ribs, however, may create areas of higher contact pressure with the image medium. The contact pressure may tend to be higher at discontinuities such as the start and end of ribs in the direction of motion of the print medium, and at the edges of the ribs perpendicular to the direction of motion. This effect may tend to be exacerbated by paper curl, manufacturing tolerances, and deliberate methods to control the shape (e.g., flatness, etc.) of the print medium.

Printing device components with ribs may be used in printers with borderless printing, duplex printing (e.g., double-sided printing), and/or other features. In duplex printing an image may be applied to one side of image medium, the image medium may be flipped or rotated, and ink may applied to a second side of the image medium. While ink is applied to the second side of the image medium, the ink recently applied to the first side of image medium may still be wet (e.g., un-dried). Un-dried or partially dried ink on an image medium may be more susceptible to scratching (e.g., removal or smearing) when the image medium comes into contact with ribs. Additionally, some image media are susceptible to scratching regardless of the presence of ink. The likelihood and/or severity of ink scratching and image medium scratching may vary with the contact pressure applied to the image medium. Contact pressure between two objects is generally inversely related to the size of contact area between the two objects. Contact between a flat sheet (e.g., an image medium) and sharp edges, sharp radius corners, and/or surfaces of small area may result in higher contact pressure than contact with smooth edges, large radius corners, curved surfaces defined by a large radius of curvature, smooth curved surfaces, and/or flat surfaces. Thus, a rib that supports an image medium on a smooth surface and/or large radius curved surfaces may reduce scratching to an image medium and ink and may, therefore, be desirable.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
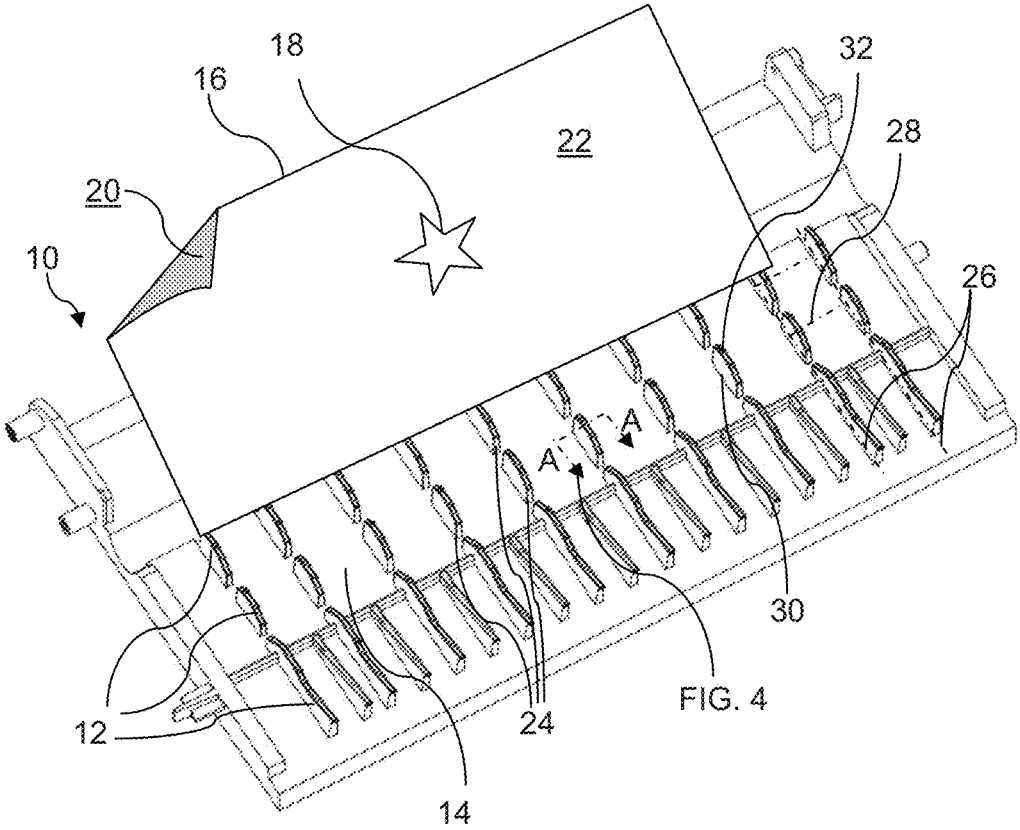
FIG. 1 is schematic diagram of a printing device component according to an embodiment of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements. Moreover, some of the blocks depicted in the drawings may be combined into a single function.

DETAILED DESCRIPTION

In the following detailed description, numerous specific details are set forth in order to provide a thorough understanding of the invention. It will however be understood by those skilled in the art that the present invention may be practiced without these specific details. In other instances, well-known methods, procedures, and components have not been described in detail so as not to obscure the present invention.

A typical printing device component with multiple ribs may exert unacceptably high contact pressure on an image medium. Use of smooth, flat, and/or large radius surfaces (e.g., surfaces defined by a large radius of curvature) that contact an image medium (e.g., paper) may reduce paper contact pressure. A printing device component, printer component, printer part, printer subsystem, or platen may include multiple ribs that together constitute a nominal guiding surface (this is the "top" surface in many geometries). The nominal guiding surface may be flat, substantially flat, curved, and/or another shape.

Each rib may include multiple major structural elements: a nominal guiding surface, an angled surface as a leading edge, an angled surface as a trailing edge, and two side angled surfaces. One or more transition surfaces may be located between the nominal guiding surface and each of the other structural elements. Adjacent to the nominal guiding surface may be a primary transition surface or surfaces in multiple directions (e.g., four directions or another number of directions). A secondary transition surface or surfaces may be adjacent to angled surface(s). A secondary transition surface or surfaces may be adjacent to a side angled surface(s). One or more secondary transition surfaces may be adjacent to the primary transition surfaces. In some embodiments, one or more secondary transition surfaces may be adjacent to the nominal guiding surface and the angled surface(s) and/or side angle surface(s).

One or more primary transition surfaces may, in some embodiments, begin at the nominal guiding surface and end at one or more secondary transition surface(s). One or more secondary transition surfaces may, in some embodiments, begin at a primary transition surface and end at an angled surface. One or more angled surfaces may, in some embodiments, begin at a secondary transition surface and end at a base surface, trough, or other feature.

The nominal guiding surface of the rib may be substantially rectangular or square, or another shape. The nominal guiding surface may be the primary surface that a print medium (e.g. a sheet of paper) contacts during printing. The multiple primary transition surfaces may be curved or rounded surfaces defined by a relatively large fixed, step-wise varying, or otherwise varying radius of curvature. The multiple secondary transition surfaces may be curved or rounded surfaces defined by a relatively small or sharp fixed, step-wise varying, or otherwise varying radius of curvature. Each angled surface may be a flat or approximately flat surface, and may start or begin at one or more of the secondary transition surfaces.

According to some embodiments, a printing device component may include multiple ribs, and each rib may include four primary transition surfaces, four secondary transition surfaces, and four angled surfaces.

A printing device component with multiple ribs with smooth, flat, and/or primary transition surfaces that contact an image medium may reduce scratches and/or lines in the ink on the image medium by mitigating localized regions of high contact pressure. Reduction of contact pressure may be particularly useful in double-sided printing, in which paper with recently applied and/or undried ink may come into contact with the ribs.

FIG. 1 is schematic diagram of a printing device component according to an embodiment of the present invention. A printing device component, printer part, or printer subsystem 10 (e.g. a platen) may include multiple ribs 12 (e.g., flanges, rib structures, fins, or other structures) and a base surface 14 (e.g., a base plate, plastic plate, metal plate, metal sheet or other material). Printing device component 10 may, in some embodiments, be fabricated from plastic (e.g., injection molded plastic, glass reinforced plastic, and/or other type of plastic), metal (e.g., a metal plate, aluminum plate, aluminum alloy plate, steel plate, sheet metal, and/or other metal structure), ceramic, and/or other material. Multiple ribs 12 may be arranged in, for example, rows in a direction of paper travel 26, a grid 28, one or more line(s), an array, and/or other pattern. Multiple ribs 12 may extend up, outward, or in another direction from base surface 14. Ribs 12 may include one or more surfaces and may support, control, bolster, and/or otherwise make contact with an image medium 16 (e.g., a sheet of paper, photographic paper, brochure paper, cardboard, wax paper, or other type of image medium) in an image printing device (e.g., during printing). Printing device component ribs 12 may, in some embodiments, include a rectangular box shaped base section or element 30 and a trapezoidal box shaped nominal guiding element 32 that extends from the rectangular box shaped base element 30. Printing device component 10 may, in some embodiments, include troughs 24 (e.g., spaces, depressions, and/or gaps) between ribs 12. Troughs 24 may, in some embodiments, collect ink 18 applied beyond the boundaries of image medium 16.

An image printing device (e.g., a printer) may apply ink 18 (e.g., pigment ink, dye ink, or other type of ink), powder, toner, wax, shaping fluid, plastic and/or other substances to image medium 16. In some embodiments, an image printing device may have duplex printing functionality (e.g., double-sided printing) and may apply ink 18, toner, or other substance to both sides of image medium 16. During a duplex printing operation, image printing device may apply ink 18 to one side 20 of image medium 16 and a short time after, ink 18 may be applied to a second side 22 of image medium 16. Ink 18 may, for example, be applied to second side 22 of image medium 16 before ink 18 on first side 20 of image medium 16 has completely dried. Ink 18 that is still wet (e.g., has not completely dried) may be easily scratched (e.g., removed, streaked, smeared, and/or distorted) when image medium 16 and/or ink 18 comes into contact with sharp edges and/or is subjected to high contact pressure.

Ink 18 may, in some embodiments, be pigment ink. Pigment ink may, for example, be more prone or susceptible to scratching than dye ink because pigment ink rests on the surface image medium 16 while dye ink may soak into image medium 16. Consequently, high contact pressure loads applied to image medium 16 with un-dried pigment ink during duplex printing may result in scratches to pigment ink 18.

Ribs 12 may, in some embodiments, be a component of a manufacturing device component other than a printer, for example, a component used in a manufacturing device to process and/or fabricate webs of material (e.g., sheet metal, packaging, toilet paper, tape, or other materials). Ribs 12 may, in some embodiments, include one or more surfaces and may support, control, bolster, and/or otherwise make contact with a web of material in a manufacturing device (e.g., during processing or fabrication of a web (e.g., sheet metal)).

Figure 2:
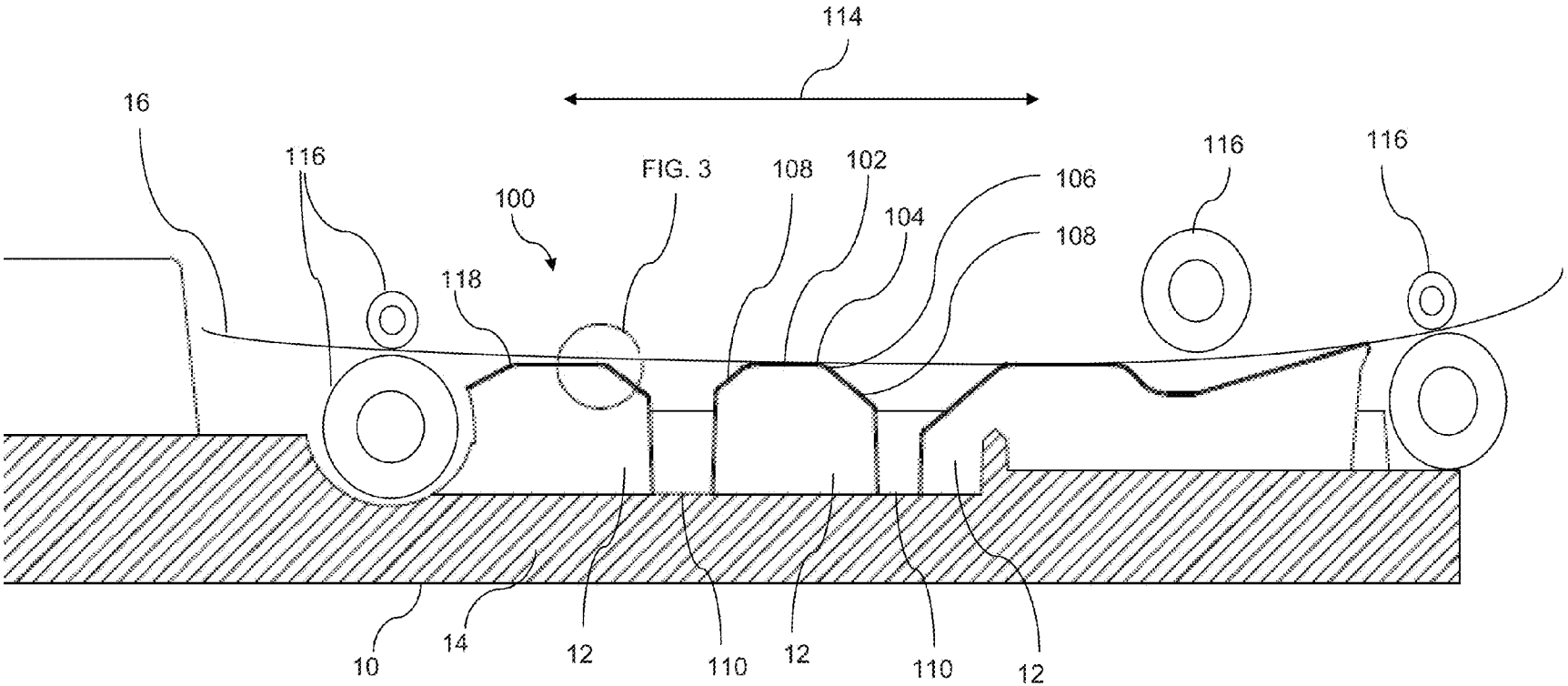
FIG. 2 is a cross-sectional view of a portion of an image printing device with ribs according to an embodiment of the present invention.

FIG. 2 is a cross-sectional view of a portion of a device such as an image printing device with ribs according to an embodiment of the present invention. A printing device component 10 may support or include ribs 12 that are components of or associated with an image printing device 100 (e.g., a printer, an inkjet printer, a laser printer, a toner based printer, solid ink printer, or other printing device). Ribs 12 may support, control, and/or otherwise make contact with an image medium 16 during printing. Image medium 16 may be advanced in image printing device 100 by one or more image medium advancing device(s) 116 (e.g., a roller, set of rollers, conveyor device, track, feeder, or other type of device) in a direction of image medium movement 114 (e.g., an axis or imaginary line). Image medium advancing device 116 may apply forces (e.g., contact pressure, tension loads, compression loads, shear loads, bending loads, torsion loads and/or other loads or forces) to image medium 16 in order to ensure that image medium 16 remains flat or substantially flat (e.g., within design parameters of the printing device) during the printing process. In some embodiments, forces and/or loads may be applied to image medium 16 by image medium advancing device 116 in conjunction with printing device component 10, ribs 12, ink application device (e.g., a printhead, ink nozzles or other device), toner application device, and/or other components of image printing device 100. Forces applied to image medium 16 may, in some embodiments, result from intentional bending of and movement of image medium 16 in printing device 100.

A rib 12 may include a nominal guiding surface 102, one or more primary transition curved surfaces 104, one or more secondary transition surfaces 106, multiple flat or substantially flat angled surfaces 108, and/or other surfaces, features, and/or elements. Ribs 12 may, in some embodiments, be 10-20 millimeters (mm) in length, and/or another range of lengths, in direction of image medium motion 114. Troughs 24 may be, in effect, the base surface 14, and thus the angled surfaces 108 may end at or transition into base surface 14. A primary transition curved surface 104 may be associated with the one secondary transition surface 106 into which it continues which may in turn be associated with the one angled surface 108 into which it continues.

Nominal guiding surface 102 may, in some embodiments, be a flat, substantially flat, and/or deliberately non-flat surface. An approximately or substantially flat surface may, in some embodiments, be a surface with a flatness tolerance of ±0.2 millimeters or another flatness tolerance or other range of tolerances.

Primary transition surface(s) 104 may, in some embodiments, have shapes defined by a relatively (compared to surface 106) large radius that is tangent to and extends from an edge of nominal guiding surface 102. Primary transition surface 104 may be tangent to nominal guiding surface 102 at a locus of intersection with nominal guiding surface. Primary transition surface 104 may, in some embodiments, be sufficiently smooth and be a sufficiently large radius so as to reduce contact pressure applied to image medium 16, ink 18, and/or other substances on image medium 16. Reducing contact pressure, loads and/or forces applied to image medium 16 may reduce scratches to image medium 16, ink 18, and/or other substances on image medium 16. Primary transition surface 104 may be principally oriented in the direction of media movement or may be oriented in another direction.

Primary transition surface 118 may be a transition surface between multiple primary transition surfaces. Primary transition surface 118 may include a surface defined by a sweep, blend or other combination of two or more primary transition surfaces.

Secondary transition surface 106 may be defined by a relatively small radius compared to the radius defining primary transition surface 104. The radius defining the shape of primary transition surfaces 104 may be greater than the radius defining the shape of the associated (e.g., adjacent or into which the surface transitions) secondary transition surfaces 106. In some embodiments, the radius defining the shape of the one or more primary transition surfaces 104 may be double, five times, or another multiple of the radius defining the shape of one or more of the secondary transition surfaces 106. The radius of un-associated, or un-adjacent primary and secondary transition surfaces may not be related. Each secondary transition surface 106 may extend from an edge of one or more primary transition surfaces 104. Secondary transition surface 106 may be sufficiently small in area so as not to contact or minimize contact with the image medium 16. Secondary transition surface 106 may be sufficiently small to only contact the leading edge or trailing edge of image medium 16.

Angled surfaces 108 (e.g., lead-in surface or trailing surface), may be flat, approximately flat, and/or substantially flat surface(s). Each angled surface 108 may extend from an edge of one or more secondary transition surfaces 106. Each angle surface 108 may, in some embodiments, extend from an edge of one or more primary transition surfaces 104 and/or a combination of one or more secondary transition surface(s) 106 and one or more primary transition surface(s) 104. Angled surfaces 108 may extend away from nominal guiding surface at angle toward base surface 14 and/or walls of trough 110. Angled surfaces 108 may form, constitute, and/or include walls and/or other structural features of trough 110. Angled surfaces 108 may function to lead, guide, and/or orient an image medium 16 to nominal guiding surface 102 of rib 12 and/or to prevent image medium 16 from getting caught in trough 110.

Multiple ribs 12 may be arranged in one or more line(s), a grid, an array, and/or a similar pattern and may extend up, outward, or in another direction from base surface 14. Printer part or printer subsystem 10 may, in some embodiments, include troughs 110 (e.g., spaces, depressions, and/or trenches) between ribs 12. Troughs 110 may, in some embodiments, be 6 mm wide, another width, and/or a range of widths.

Figure 3:
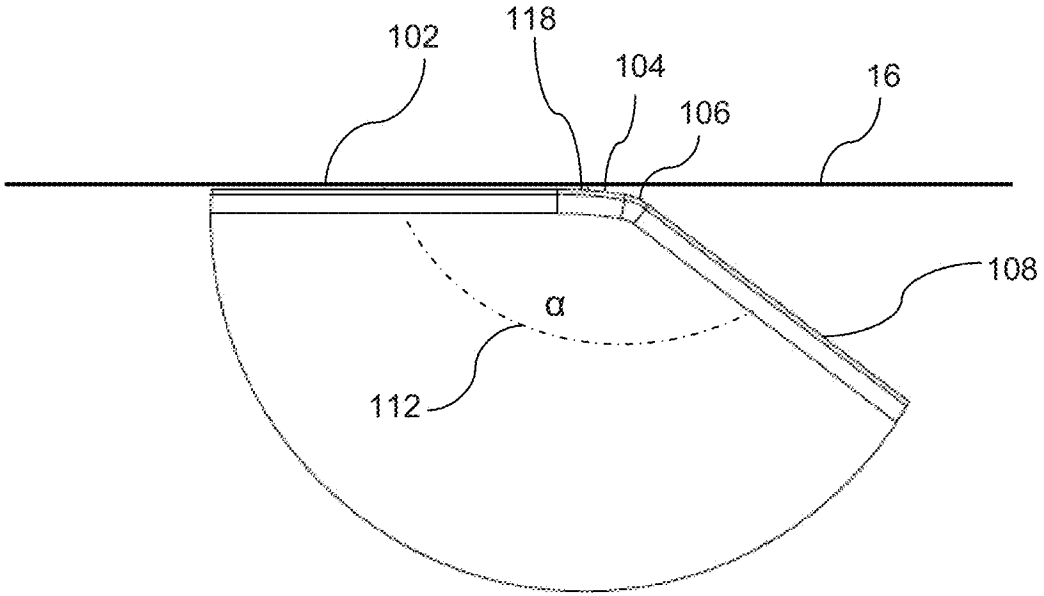
FIG. 3 is a detail view of a rib according to an embodiment of the present invention.

FIG. 3 is a detail view of a portion of a rib according to an embodiment of the present invention. Nominal guiding surface 102 may, in some embodiments, be a flat, approximately flat, and/or substantially flat surface. Primary transition surface 104 may be a smooth, gentle angled, gentle sloped (e.g., relative to surface 106), and/or otherwise contoured surface. Primary transition surface 104 and nominal guiding surface 102 may be the primary surfaces, portion and/or structures of rib that contact image medium 16 during printing. Primary transition surface 104 may be a sufficiently large, smooth radius surface, and/or devoid of sharp corners such that contact forces applied to an image medium 16 in contact with primary transition surface 104 may be minimized, reduced, mitigated, and/or controlled. Each primary transition surface 104 may, in some embodiments, be defined by a different radius. Primary transition surface 104 may, for example, be defined by a sweep of reducing, increasing, step-wise reducing, step-wise increasing, or otherwise varying radius of curvature. One primary transition surface 104 may, for example, be defined by a 4 millimeter (mm) radius, a radius larger than 4 mm, another radius, or a sweep with a large and varying radius of curvature. Other primary transition surface(s) 104 may be defined by the same radius or sweep, or by other radii or sweeps. Primary transition surfaces 104 may, in some embodiments, be defined by another radius of curvature, and/or range of radii, or another range of sweeps. Primary transition surface 104 may, for example, be defined by a portion of a 4 mm or larger radius curve and primary transition surface 104 may not follow the full 4 mm radius. Primary transition surface 104 may, in some embodiments, be defined by a sweep of varying radius in the range of 2-10 millimeters, or a sweep of another range of radii. Primary transition surface 104 may, in some embodiments, be defined by a radius of curvature that transitions from a relatively large radius of curvature (e.g., greater than 4 mm or another range of radii) at the start or beginning (e.g., at the intersection with nominal guiding surface 102) to a relatively small radius of curvature (e.g., less than 2 mm or another range of radii) a short distance from the beginning (e.g., 0.1 mm or another distance). "Large" in this context typically means large relative to the associated or connected small radius or secondary transition surface.

Secondary transition surface 106 may, in some embodiments, be defined by a small (relative to surface 104) transition radius or sweep with a varying but small radius between primary transition surface 104 and angled surface 108. Secondary transition surface 106 may, for example, be defined by a sweep of reducing, increasing, step-wise reducing, step-wise increasing, or otherwise varying radius of curvature. Secondary transition surface 106 may, in some embodiments, be a relatively small in area compared to primary transition surface 104. Secondary transition surface 106 may, in some embodiments, be sufficiently small in surface area to ensure that secondary transition surface 106 does not come into contact with image medium 16 and/or minimally contacts image medium 16 during printing device 100 operation. Each secondary transition surface 106 may, in some embodiments, be defined by a different radius or sweep. One secondary transition surface 106 may, for example, be defined by a radius of curvature smaller than 2 mm, 0.5 to 2 mm and/or another radius or range of radii, and other secondary transition surface(s) 106 may be defined by the same radius and/or one or more other radii, or by another sweep. Secondary transition surfaces 106 may, in some embodiments, be defined by another radius of curvature, and/or range of radii or sweeps. One secondary transition surface 106 may, for example, be defined by a portion of a 0.5-2 mm radius curve, and another secondary transition surface 106 may not follow the full 0.5-2 mm radius. Secondary transition surface 106 may, in some embodiments, be defined by a sweep of varying radius in the range of 0.1-2 millimeters or a sweep of another range of radii. "Small" in this context typically means small relative to the radius of the associated or connected primary transition surface.

Angled surfaces 108 may be flat, approximately flat, and/or substantially flat surface(s). Each angled surface 108 may extend from an edge of one or more secondary transition surfaces 106. Angled surfaces 108 may extend away from nominal guiding surface 102 at an angle ($\alpha$) 112 to surface 102. Angles ($\alpha$) 112 between multiple angled surfaces 108 and nominal guiding surface 102 may vary from one another, even on the same rib. For example, angle ($\alpha$) 112 between a forward angled surface (e.g. meeting the paper first in the typical direction of paper travel) and nominal guiding surface 102 may be one angle and angle (α) 112 between an aft angled surface (e.g., a rear angled surface) and nominal guiding surface 102 may be another angle. Angle (α) 112 may, in some embodiments, be 120 degrees (°), another angle and/or another range of angles. Angle surface 108 may extend to a wall of trough 110 between ribs 12, to base surface 14, or to another structure, surface, element, and/or feature of printing device component 10. Angled surface 108 may, in some embodiments, extend to second angled surface, structure, and/or feature of rib 12.

Rib 12 may include primary transition curved surfaces 104, secondary transition curved surfaces 106, and angled surfaces 108 in order create a smooth transition from nominal guiding surface 102 to trough 110 in the direction of paper travel 114. Primary transition curved surface 104 may, in some embodiments, extend from nominal guiding surface 102 to one or more angled surfaces 108. However, secondary transition curved surface 106 may, in some embodiments, function to provide a transition between a roughly horizontal sloping primary transition surface 104 and angled surfaces 108, which extend downward at an angle. Secondary transition surfaces may serve to allow angled surfaces to angle toward the base surface at a sufficiently steep angle to allow troughs to be formed.

Figure 4:
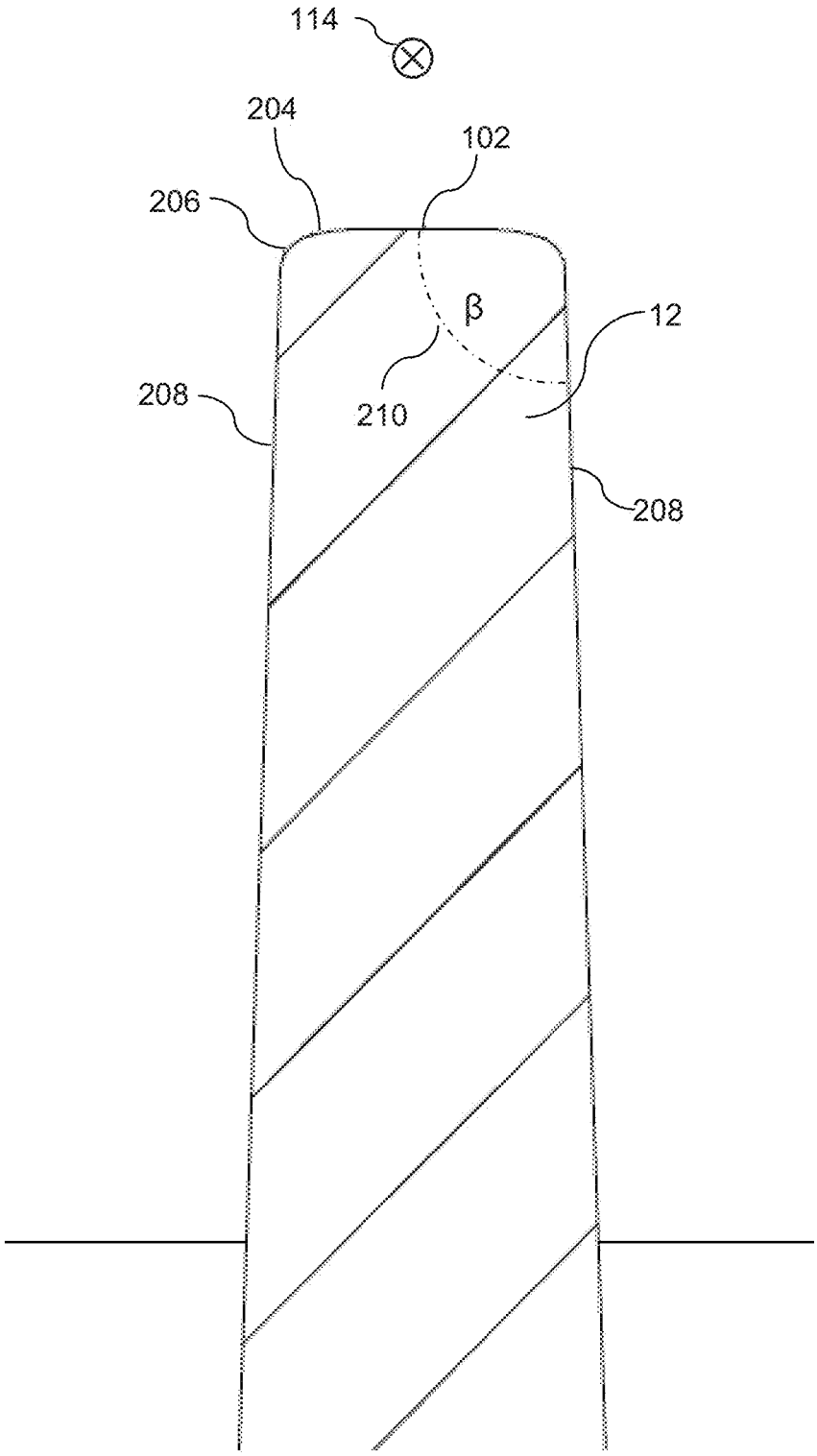
FIG. 4 is a cross-sectional view of a rib when viewed in the operational direction of image medium movement according to an embodiment of the present invention.

FIG. 4 is a cross-sectional view of a rib when viewed in the operational direction of image medium movement according to an embodiment of the present invention. FIG. 4 may be a cross-sectional view of rib 12 in the direction of image medium movement 114 (e.g., axis or imaginary line), in a direction perpendicular to the view direction of FIG. 3, and/or in another direction. Rib 12 may, in some embodiments, be 2 mm in width, another width, and/or another range of widths. Rib 12 may, for example, be 10 mm in height, another height, and/or another range of heights.

Nominal guiding surface 102 may, in some embodiments, be a flat, approximately flat, and/or substantially flat surface. Primary transition curved surface(s) 204 may, in some embodiments, be defined by and/or lie on a relatively large radius, radius of curvature, or sweep with varying radii. Each primary transition surface 204 may extend from an edge of nominal guiding surface 102. Primary transition surface 204 may be tangent to nominal guiding surface 102 at a locus of intersection with nominal guiding surface 102. Primary transition surface(s) 204 may be defined by and/or lie on a sufficiently large radius of curvature such that primary transition surface(s) 204 may reduce contact pressure, forces, and/or loads applied to image medium 16. Primary transition surface 204 may, in some embodiments, be sufficiently large that secondary transition surface 206 does not make contact with image medium 16 or make minimal contact with image medium 16.

Each primary transition surface 204 may, in some embodiments, be defined by a different radius or sweep; in some embodiments, some or all such radii or sweeps may be the same. One primary transition surface 204 may, for example, be defined by a 4 millimeter (mm) radius, other primary transition surface(s) 204 may be defined by the same radius and/or one or more other radii or sweep of varying radii. Primary transition surfaces 204 may, in some embodiments, be defined by another size radius and/or range of radii. One primary transition surface 204 may, for example, be defined by a portion of a 4 mm radius curve and another primary transition 204 surface may not follow the full 4 mm radius. Primary transition surface 204 may, in some embodiments, be defined by a sweep of varying radius in the range of 2-10 millimeters, or a sweep of another range of radii.

Secondary transition surface 206 may be defined by a relatively small radius or radius of curvature compared to the radius defining primary transition surface 204. Each secondary transition surface 206 may extend from an edge of one or more primary transition surfaces 204. Each secondary transition surface 206 may, in some embodiments, be defined by a different radius, or by a sweep of varying radius; in some embodiments, some or all such radii or sweeps may be the same. One secondary transition surface 206 may, for example, be defined by a radius smaller than 2 mm, a 0.5 to 2 mm radius and/or other radius or range of radius and other secondary transition surface(s) 206 may be defined by the same radius and/or one or more other radii, or by a sweep. Secondary transition surfaces 206 may, in some embodiments, be defined by another size radius, and/or range of radii. Secondary transition surface 206 may, for example, be defined by a portion of a 0.5-2 mm radius curve, and secondary transition surface 206 may not follow the full 0.5-2 mm radius. Secondary transition surface 206 may, in some embodiments, be defined by a sweep of varying radius in the range of 0.1-2 millimeters or a sweep of another range of radii.

Angled surfaces 208 may be flat, approximately flat, and/or substantially flat surface(s). Each angled surface 208 may extend from an edge of one or more secondary transition surfaces 206. Each angle surface 208 may, in some embodiments, extend from an edge of one or more primary transition surfaces 204 and/or a combination of one or more secondary transition surface(s) 206 and one or more primary transition surface(s) 204. Angle surfaces 208 may extend away from nominal guiding surface 102 at an angle (β) 210. Angle (β) 210 between multiple angled surfaces 208 and nominal guiding surface 102 may vary from one another. For example, angle (β) 210 between one angled surface and nominal guiding surface 102 may be one angle, and angle (β) 210 between another angled surface and nominal guiding surface 102 may be another angle. Angle (β) 210 may, in some embodiments, be 90-100 degrees (°), another angle, and/or another range of angles. Angle surface 208 may extend to a wall of trough 110 between ribs 12, to base surface 14, or to another structure, surface, element, and/or feature of printing device component 10. Angle surface 208 may, in some embodiments, extend to second angled surface, structure, and/or feature of rib 12.

According to some embodiments, two primary transition surfaces 104 (e.g., a pair of primary transition surfaces 104) and two primary transition surfaces 204 (e.g., a pair of primary transition surfaces 204) may extend from nominal guiding surface 102. Primary transition surface 118 may be in the shape of a sweep generated from the sweep or blend or other combination of primary transition surface 104 and primary transition surface 204. Primary transition surface 104 may meet primary transition surface 204 at the corners of rib nominal surface 102. Primary transition surface 104 may transition to primary transition surface 204 in a spheroidal, ellipsoidal, B-spline, or sweep surface 118. Surface 118 may be shaped to avoid excessive peaks in contact pressure with image medium 16. One or more primary transition surface(s) 104, one or more primary transition surface(s) 204, and one or more primary transition surface(s) 118 may form one or more primary transition surface(s), large radius surfaces, primary transition structure(s), or other structure which contact image medium 16 during printing.

According to some embodiments, two secondary transition surfaces 206 (e.g., a pair of secondary transition surfaces 206) may be generated from the sweep or blend or other combination of the line defined by nominal surface 102, primary transition surface(s) 104, secondary transition surface(s) 106, and angled surface(s) 108 with angled surface 208. Secondary transition surface 206 may be defined by a blended, spheroidal, ellipsoidal, B-spline or sweep surface. Surface 206 may be shaped to avoid or minimize contact under expected conditions with image medium 16 during printing.

In one embodiment, one pair of primary transition surfaces 104 extends in a substantially perpendicular direction to another pair of primary transition surfaces 204. A pair of primary transition surfaces 104 and a pair of primary transition surfaces 204 may, for example, both extend from, share and/or otherwise be connected to nominal guiding surface 102. Each of a pair of secondary transition surfaces 106 may, for example, extend from a primary transition surface 104 to an angled surface 108. Each of a pair of secondary transition surfaces 206 may, for example, each extend from a primary transition surface 204 to an angled surface 208. Each of a pair of angled surfaces 108 may, in some embodiments, extend from secondary transition surface 106 to rib trough 110. Each of a pair of angled surface 208 may, in some embodiments, extend from secondary transition surface 206 to rib trough 110. Other structural configurations may also be used; for example, each rib may have other numbers (e.g., one, two, etc.) of primary transition surfaces, secondary transition surfaces, etc.

In some embodiments, primary transition surface 104 and/or primary transition surface 204 may be modeled as cylinders and image medium 16 may be modeled as a flat surface. The contact stresses between image medium 16 and primary transition surface 104 and/or primary transition surface 204 may, for example, be modeled as a cylinder (e.g., primary transition surface 104, primary transition surface 204) contacting a flat surface (e.g., image medium 16). In some embodiments, the following formula may be used to calculate the maximum contact pressure between a cylinder and a flat surface, $\sigma_{max}$:

$$\sigma_{max} = 0.798 \times \sqrt{\frac{P}{2rC_E}}$$

The contact pressure between a cylinder and a flat surface, $\sigma_{max}$, may be determined by solving the above equation, where load, P, may be the load or force applied by cylinder to flat surface, load or force applied by flat surface to cylinder, and/or load or force between flat surface and cylinder. Radius, r, may be the radius of the cylinder (e.g., primary transition surface 104, primary transition surface 204). Constant, $C_E$, may be a constant representing the relationship, ratio, proportionality, and/or relation between the Poisson's ratios, v, and elastic moduli, E, of cylinder (e.g., primary transition surface 104, primary transition surface 204) and flat surface (e.g., image medium 16). Because contact pressure, $\sigma_{max}$, may, in some embodiments, be modeled as inversely proportional to the square root of the radius of the cylinder, r, (e.g., primary transition surface 104, primary transition surface 204), increasing radius, r, may reduce contact pressure, $\sigma_{max}$.

According to some embodiments, the contact pressure between image medium 16 and rib 12 may, for example, be mathematically modeled, represented, or approximated by modeling a sphere contacting a flat surface, a cylinder contacting a flat surface, or other mathematical and/or physical model. In some embodiments, primary transition surfaces (e.g., primary transition surface 118) may be modeled as spheres, and image medium 16 may be modeled as a flat surface. In some embodiments, the following formula may be used to calculate and/or approximate the maximum contact pressure between a sphere and a flat surface, $\sigma_{max}$:

$$\sigma_{max} = 0.918 \times \sqrt[3]{\frac{P}{4r^2C_E^2}}$$

The contact pressure between a sphere and a flat surface, $\sigma_{max}$, may be determined by solving the above equation, where load, P, may be the load or force applied by sphere to flat surface and/or load or force applied by flat surface to sphere. Radius, r, may be the radius of the sphere (e.g., primary transition surface 118, using the smallest and largest effective radii for bounding conditions). Constant, $C_E$, may be a constant representing the relationship, ratio, proportionality, and/or relation between the Poisson's ratios, v, and elastic moduli, E, of sphere (e.g., primary transition surface 118) and flat surface (e.g., image medium 16). Because contact pressure, $\sigma_{max}$, may, in some embodiments, be inversely related (e.g., related by a negative power) to the radius of sphere, r, (e.g., primary transition surface 104, 204, and/or 118), increasing radius, r, may reduce contact pressure, $\sigma_{max}$.

Primary transition surfaces 104, 118, and 204 may be defined by significantly larger radii than secondary transition surfaces 106 and 206. Primary transition surface 104 and/or primary transition surface 204 may, therefore, apply less contact pressure, loads, and/or forces to image medium 16 than secondary transition surface 106 and/or secondary transition surface 206 when a print medium contacts the surfaces. Reducing the contact pressure, $\sigma_{max}$, between rib 12 and image medium 16 may reduce scratches to image medium 16; scratches, lines, smears, and/or damage to ink 18; and/or other defects. Other models, mathematical approaches, formulas, physical models, and/or analytical approaches may be used. Other or different benefits may be realized by embodiments of the invention.

Features of various embodiments discussed herein may be used with other embodiments discussed herein. The foregoing description of the embodiments of the invention has been presented for the purposes of illustration and description. It is not intended to be exhaustive or to limit the invention to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the invention.

What is claimed is:

1. A printing device component comprising: a base surface; and a plurality of ribs extending away from the base surface, each rib comprising: a nominal guiding surface; one or more primary transition surfaces; one or more secondary transition surfaces; one or more angled surfaces;

each primary transition surface beginning at the nominal guiding surface and ending at a secondary transition surface;

each secondary transition surface beginning at a primary transition surface and ending at an angled surface; and each angled surface beginning at a secondary transition surface and ending at the base surface;

the one or more primary transition surfaces comprise up to four primary transition surfaces, each primary transition surface extending in a different direction from said nominal guiding surface;

the one or more secondary transition surfaces comprise up to four secondary transition surfaces, each secondary transition surface extending from a corresponding one of said primary transition surface; and the one or more angled surfaces comprise up to four angled surfaces, each angled surface extending from a corresponding one of said secondary transition surface.

2. The printing device component of claim 1, wherein:

the one or more primary transition surfaces each are defined by a first radius of curvature;

the one or more secondary transition surfaces each are defined by a second radius of curvature; and the first radius is larger than the second radius.

3. The printing device component of claim 1, wherein each of the one or more angled surfaces extends from the secondary transition surface at an angle relative to the nominal guiding surface.

4. The printing device component of claim 1, wherein the normal guiding surface and the one or more angled surfaces are substantially flat surfaces.

5. The printing device component of claim 1, wherein the plurality of ribs comprises a plurality of ribs arranged in rows in a direction of image medium travel.

6. The printing device component of claim 1, wherein the one or more primary transition surfaces comprise surfaces defined by a radius larger than 4 millimeters and the one or more secondary transition surfaces comprise surfaces defined by a radius less than 2 millimeters.

7. The printing device component of claim 1, wherein the one or more primary transition surfaces comprise surfaces defined by a sweep of fixed or varying radius in a range of 2-10 millimeter radius and the one or more secondary transition surface comprises surfaces defined by a sweep of fixed or varying radius in a range of 0.1-2 millimeter radius.

8. A printer part comprising: a base surface;

and a plurality of ribs extending away from the base surface, each rib comprising:

a trapezoidal box shaped nominal guiding element comprising:

one or more lead-in surfaces;

one or more secondary transition curved surfaces, each beginning at one or more of the lead-in surfaces;

one or more primary transition curved surfaces, each beginning at one or more of the secondary transition curved surfaces; and a nominal guiding surface beginning at the primary transition curved surfaces, the one or more lead-in surfaces of said ribs consist of four angled surfaces;

the one or more secondary transition curved surfaces of said ribs consist of four curved surfaces, each associated with one angled surface and one lead-in surface; and the one or more primary transition curved surfaces of said ribs consist of four curved surfaces.

9. The printer part of claim 8, wherein the one or more primary transition surfaces each comprise surfaces defined by a sweep of fixed or varying radius of curvature.

10. The printer part or printer subsystem of claim 8, wherein:

the one or more primary transition curved surfaces each comprise a surface lying on a first radius;

the one or more secondary transition curved surfaces each comprise a surface lying on a second radius; and the first radius is at least double the second radius.

11. A printing device component comprising: a base surface; and a plurality of ribs extending away from the base surface, each rib comprising: a nominal guiding surface; one or more primary transition surfaces; one or more angled surfaces; each primary transition surface beginning at a nominal guiding surface and ending at an angled surface;

the one or more lead-in surfaces of said ribs consist of four angled surfaces;

the one or more primary transition curved surfaces of said ribs consist of four curved surfaces, each associated with one angled surface and one lead-in surface.

12. The printing device component of claim 11, wherein:

the primary transition surface is tangent to the nominal guiding surface at a locus of intersection with the nominal guiding surface.

13. The printing device component of claim 11, wherein:

the one or more primary transition surfaces comprise surfaces defined by a sweep of fixed or varying radius of curvature, wherein the radius of curvature transitions from a relatively large radius of curvature at the beginning to a relatively small radius of curvature.

* * * * *

UNITED STATES PATENT AND TRADEMARK OFFICE

CERTIFICATE OF CORRECTION

PATENT NO. : 8,474,972 B2
APPLICATION NO. : 13/178222
DATED : July 2, 2013
INVENTOR(S) : Donald Christopher Sutton et al.

It is certified that error appears in the above-identified patent and that said Letters Patent is hereby corrected as shown below:

In the Claims:

In column 11, line 18, in Claim 4, delete “normal” and insert -- nominal --, therefor.

Signed and Sealed this
Tenth Day of September, 2013

Teresa Stanek Rea
*Acting Director of the United States Patent and Trademark Office*